United States Patent [19]

Costa et al.

[11] Patent Number: 4,564,187

[45] Date of Patent: Jan. 14, 1986

[54] SHEET FEED DEVICE FOR A PRINTER OR TYPEWRITER

[75] Inventors: Jorge Costa; Wolfgang Reichel, both of Yverdon, Switzerland

[73] Assignee: Hermes Precisa International S.A., Yverdon, Switzerland

[21] Appl. No.: 616,149

[22] Filed: Jun. 1, 1984

[30] Foreign Application Priority Data

Jun. 3, 1983 [CH] Switzerland ..... 3056/83

[51] Int. Cl.[4] ..... B65H 1/28; B65H 5/26

[52] U.S. Cl. ..... 271/9; 271/118; 271/246; 271/114; 400/624; 400/605; 400/636.2; 400/649

[58] Field of Search ..... 271/9, 10, 4, 114, 116, 271/118, 245, 246; 400/605, 624, 625, 630, 631, 608.2, 636.2, 608.4, 649

[56] References Cited

U.S. PATENT DOCUMENTS

| | | | |
|---|---|---|---|
| 4,084,805 | 4/1978 | Simpson | 271/4 |
| 4,222,557 | 9/1980 | Wu | 400/625 |
| 4,475,731 | 10/1984 | Wood | 271/9 |

*Primary Examiner*—Bruce H. Stoner, Jr.
*Assistant Examiner*—James E. Barlow
*Attorney, Agent, or Firm*—Emory L. Groff, Jr.

[57] ABSTRACT

The sheet feed device (1) comprises several cassettes (13) on which the sheets (11) are stacked, a removal mechanism, associated with each of the supports, intended to remove a sheet from the cassette (13) and introduce it into the printer (2), and a selection mechanism intended to activate one of the removal mechanisms. This selection mechanism consists of a guide part (72) comprising several tracks (73 to 75) and a selection lever (56) made to engage with the top of guide part (72). When the platen (3) of the printer (2) turns in the direction opposite the direction of introduction of the paper, the selection lever (56) is driven in the same direction. After a rotation of a predetermined angle, greater than two turns of the platen, the direction of rotation is reversed. The lever (56) follows one of the tracks (73 to 75) to activate one of the removal control parts (76 to 78) and to start the removal and introduction process. This arrangement makes possible, on the one hand, an uncomplicated drive control comprising only a single reversal of the drive direction and, on the other hand, the possibility of rolling back the platen (3) to correct or complete a previously printed line, without thereby starting a new selection and removal cycle.

9 Claims, 4 Drawing Figures

SHEET FEED DEVICE FOR A PRINTER OR TYPEWRITER

This invention relates to a sheet feed device for a printer or a typewriter comprising a frame, one or more supports on which the sheets to be printed are stored in a stack, a removal mechanism, associated with each of the supports, intended to remove a sheet from the support for its introduction into the printer, and a selection mechanism intended to activate one of the removal mechanisms, the selection mechanism and removal mechanisms being driven by a drive element in two opposite directions.

This design is already known from German patent DE 2.950.707. The device described in that patent comprises a selection mechanism driven by the platen making it possible to activate one of the paper removal mechanisms by driving the platen first over a predetermined distance in a first direction opposite the introduction of the paper, reversing the driving direction over a short predetermined distance, then again driving the platen in the first direction to make the sheet advance to the platen and a third time reversing the driving direction of the platen to introduce the paper into the printer. This mode of operating is complicated. Further, when a sheet introduced into the printer is partially printed and the operator wishes to complete or correct a previously written line, the device described in this German patent permits going back only a few lines, otherwise one of the removal mechanisms is driven to cause a sheet to advance toward the printer which can disturb the operation of the device.

The device according to this application aims at remedying these drawbacks and for this purpose is characterized in that the selection mechanism comprises a selection lever driven by a drive element and a guide part working with a portion of the selection lever, this guide part comprising a selection slide working with said portion and a number of guide tracks for this portion at least equal to the number of removal mechanisms, the device comprising, associated with each of the guide tracks, a removal control part made to work with the selection lever, each of the guide tracks comprising an opening though which it communicates with the selection slide, the selection lever being pulled by an elastic element to a rest position from which it is driven in a first direction along the selection slide to said openings, which are made so that said portion follows one of the guide tracks, when the selection lever is moved in a second direction opposite the first direction to work with one of the removal control parts.

The accompanying drawing shows, by way of example, an embodiment of the device, object of the invention.

Figure 1:
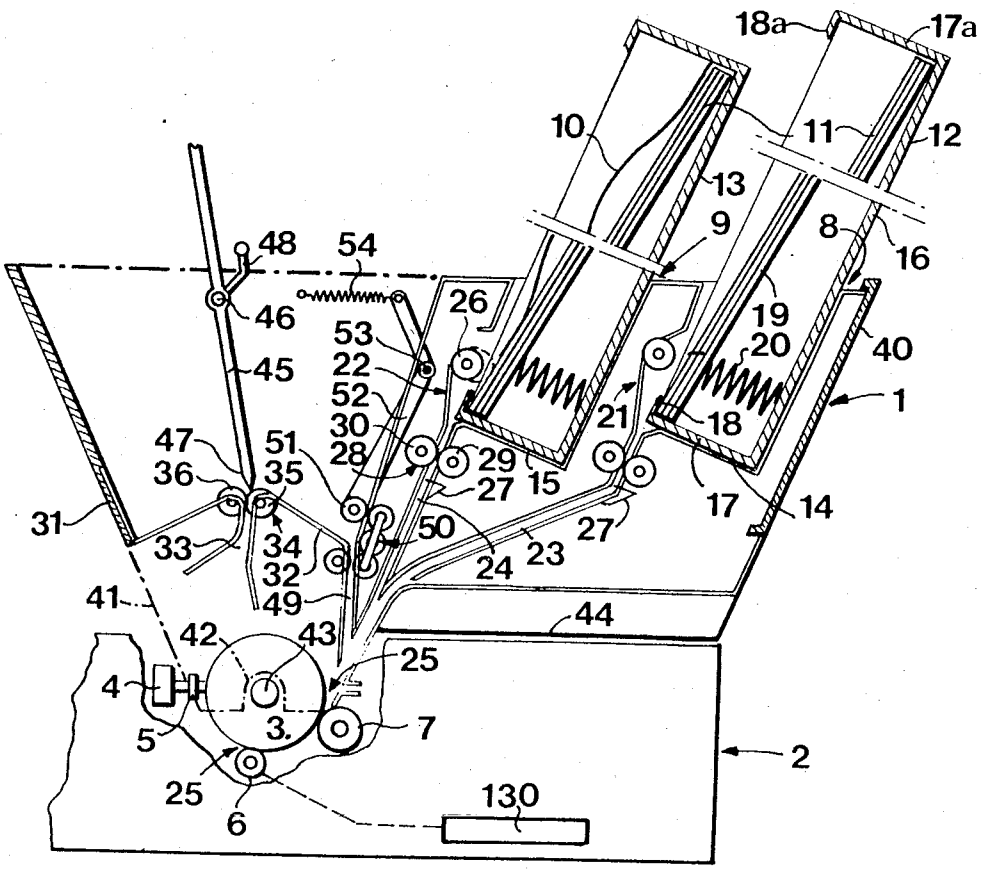
FIG. 1 is a side view in section showing the entire unit mounted on a printer.

With reference to FIG. 1, sheet feed device 1 is mounted on a printer 2 or typewriter comprising a platen 3 and a mobile carriage 4 that can move along the platen and carrying a writing device 5 such as a dot matrix head or daisy wheel. A drive shaft 6, connected to a drive motor, preferably a stepping motor, not shown, drives platen 3. Counterpressure rollers, only one of which, 7, is shown, are pulled elastically against the platen and constitute a drive mechanism 25 making it possible to make a sheet of paper, introduced into the printer, advance in a known way.

Feed device 1 comprises a frame 40 whose side walls 41 exhibit notches 42 fitting on shaft 43 of platen 3. Base 44 of the frame rests on the back part of printer 2. Feed device 1 comprises supports 8 and 9 on which sheets 11 to be printed are stored. These supports comprise cassettes 12 and 13, that can be placed on holding plates 14, 15 and can be removed from these positions. Cassettes 12, 13, rectangular in shape, comprise a bottom 16 and side walls 17, **17*a*. These latter have holding elements 18, 18*a* in their upper part, in the form of rims intended to hold sheets 11 placed on a support plate 19. This plate 19 is pushed in its lower part by a spring 20 in the direction of holding elements 18. At its upper part plate 19 is held approximately in contact with bottom 16**.

A removal mechanism 21, 22, is associated with each of supports 8, 9 and serves to shift and remove the top sheet from the stack of sheets 11 and to transport it by a channel 23, 24 to paper drive device 25. As described in detail below, this mechanism is made to transport the sheet upwards with the aid of a roller 26. The lower edge of the sheet is then disengaged from holding elements 18 and the sheet, hitting against the upper wall **17*a* of the cassette, forms a buckle 10. Roller 26 then drives the sheet in the opposite direction. The lower edge passes above holding elements 18 and buckle 10 is eliminated. Roller 26 is then disengaged from the sheet which falls freely against an alignment stop 27. A transport device 28, consisting of two rollers 29, 30, is then activated to introduce the sheet in a controlled fashion into printer 2 where it is taken by drive device 25**.

Device 1 further comprises two supports 31 and 32 intended to store the printed sheets. After printing, these sheets pass into exit channel 33 where they are carried by transport device 34 also consisting of two drive rollers 35 and 36 to be placed in normal order on support 31 or in reverse order on support 32. Wall 45 separating the two supports is mounted for this purpose to rotate around a pivot 46. A handle 48 allows this wall 45 to be locked in a given position. Lower edge 47 of wall 45 exhibits two guide surfaces guiding the sheets as they exit channel 33 either to the left on support 31 or to the right on support 32.

Support 32 can also be used as a support for feeding envelopes to be printed. It has for this purpose, in its lower part, a channel 49 suitable for guiding the envelopes toward platen 3. Removal mechanism 50 is placed at the lower part of support 32 and permits shifting and carrying of the lowest envelope of a stack placed on support 32. The stack of envelopes is held by rollers 51 placed on a crossbar fastened to one end of a bent lever 52 mounted to rotate around a pivot 53. Rollers 51 are pulled by a spring 54 in the direction of the back wall of support 32. In case the support is used as a container for the sheets already printed, rollers 51 rest on this wall in such a way as to obstruct entry from channel 49.

Figure 2:
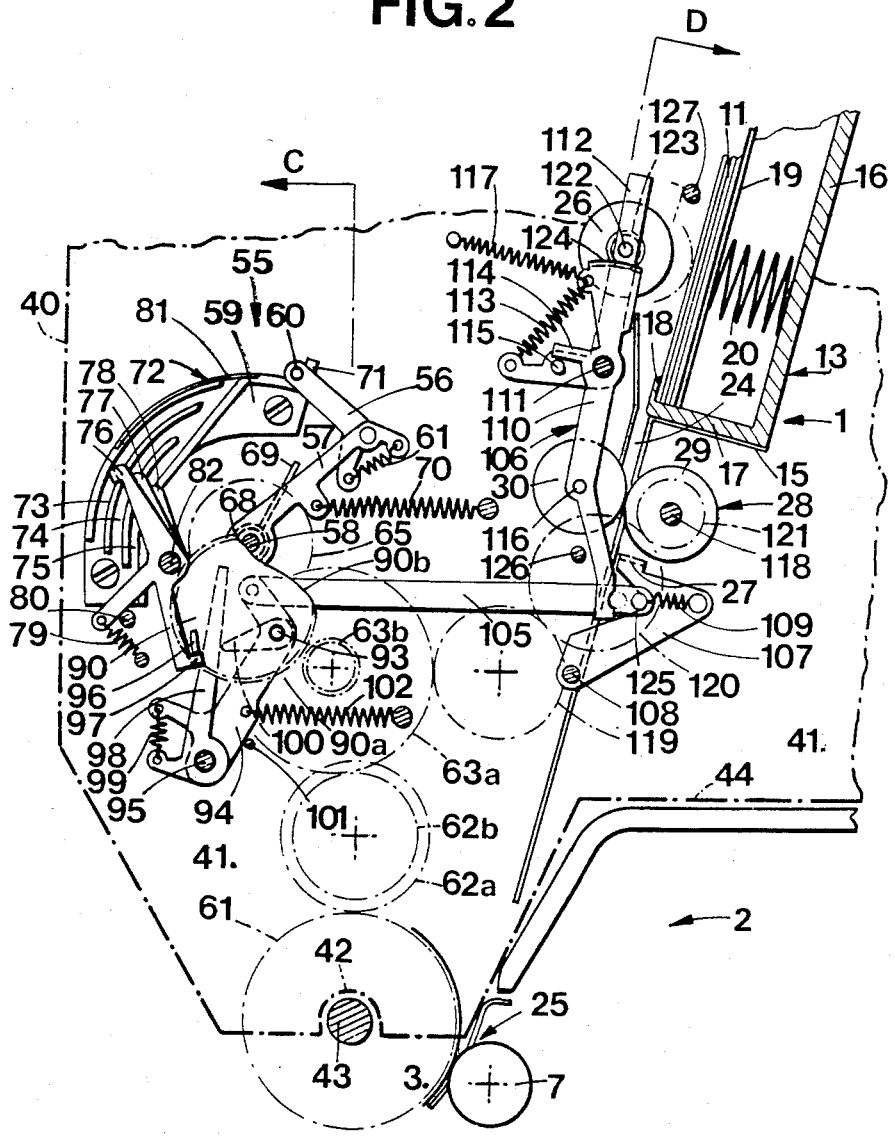
FIG. 2 is a side view illustrating the features of the device.
Figure 3:
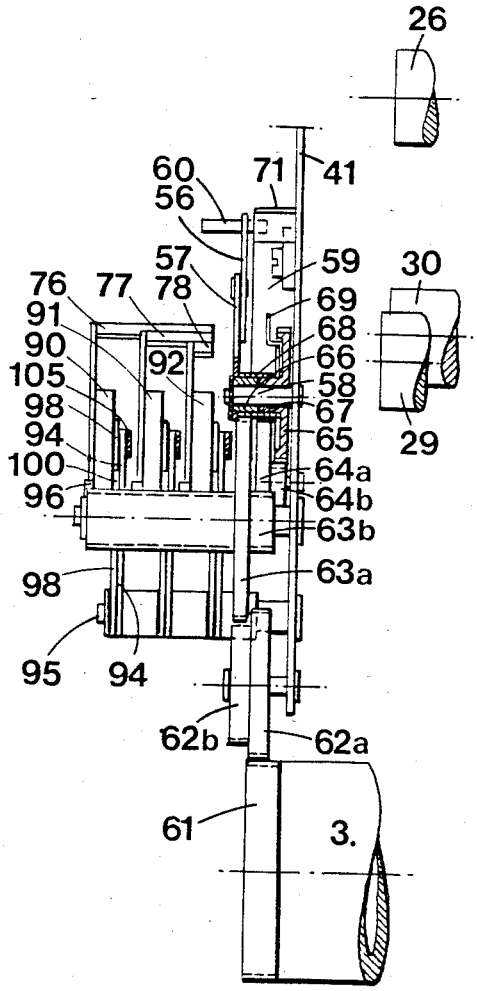
FIG. 3 is a view in section along C of FIG. 2.
Figure 4:
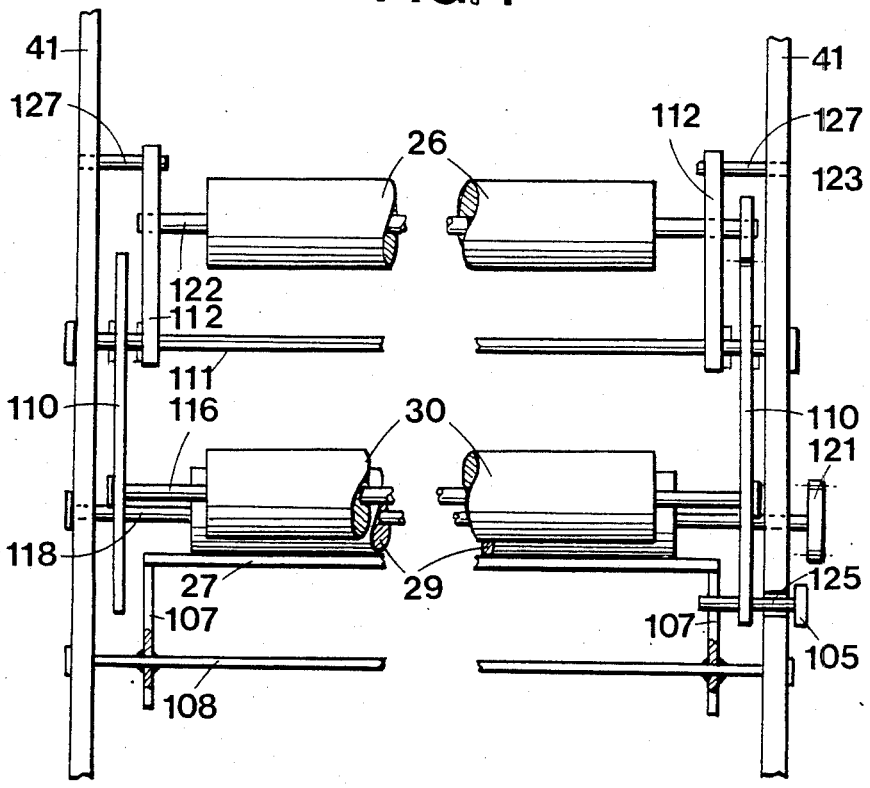
FIG. 4 is a view in section along D of FIG. 2, some of the elements not being shown, for the sake of clarity.

In reference to FIGS. 2 to 4, the feed device comprises a selection mechanism 55 intended to activate at the user's choice one of removal mechanisms 21, 22, 50. This selection mechanism 55 comprises a selection lever 56 mounted to rotate at one of the ends of a selection arm 57 whose other end is solid with a sleeve 66 mounted to turn around a shaft 58. A guide part 59 works with a pin 60 going through the end of selection lever 56. A spring 61 connects lever 56 to arm 57 to pull pin 60 against guide part 59. Arm 57 is driven by platen 3 as a result of a series of gears 61 to 65 so that arm 57 rotates around shaft 58 in the same direction as platen 3 rotates around shaft 43. Toothed wheel 65, mounted to rotate around shaft 58, comprises a sleeve 67 connected by an overriding clutch to sleeve 66 solid with selection arm 57. The clutch consists of a spring clutch 68. One end of the spiral spring of clutch 68 is fastened rigidly to sleeve 66, while the other end is wound around sleeve 67 and comprises an extension 69. Selection arm 57 is pulled by a spring 70 to a rest position in which pin 60 is held against stop 71 of guide part 59. The winding of the spiral spring of clutch 68 is such that sleeves 66 and 67 are coupled, when wheel 65 turns counterclockwise as viewed in FIG. 2. On the other hand, sleeve 67 can continue to turn right, when selection lever 56 is stopped by stop 71. In the case shown in FIG. 2, this winding of spring 68 should be righthanded. Extension 69 of the spring can come in contact with a stop consisting of a shaft 82 and is locked by this latter when toothed wheel 65 turns left. This locking of extension 69 has the effect of slightly opening spring 68 wound around sleeve 67 and of uncoupling selection arm 57 from drive device 61 to 65.

Guide part 59 of the selection mechanism comprises a selection slide 72, along the top of which pin 60 is guided when the selection lever turns counterclockwise as veiwed in FIG. 2, and a number of guide tracks 73 to 75 equal to the number of removal mechanisms 21, 22, 50.

Selection slide 72 and guide tracks 73 to 75 consist of sectors of concentric circles. The axis of rotation of selection arm 57 is merged with the center of these concentric circles. Guide tracks 73 to 75 comprise openings communicating with selection slide 72 so that pin 60 can follow one of the guide tracks when lever 56 is driven in the opposite direction or the clockwise direction as viewed in FIG. 2. Therefore, the extent of the movement of lever 56 in the counterclockwise as viewed in FIG. 2 direction determines the guide track followed by pin 60. The feed device comprises, associated with each of the guide tracks, a removal control part, such as rockers 76 to 78. These rockers 76 to 78 are mounted to rotate on shaft 82 and engage by a fold with pin 60, when this latter takes the corresponding guide track. A rotation of one of the rockers causes the start of the corresponding removal mechanism. Pulled by a spring 79, the rocker then falls back in its rest position determined by stop 80.

To guide selection lever 56 to its rest position, guide tracks 73 to 75 meet and communicate with selection path 72 by an opening covered by an elastic blade 81 to permit exit of pin 60 in the direction of the rest position but preventing any entry of this pin 60 when it is moved from right to left.

Each of the removal mechanisms associated with the paper supports comprises a cam 90 to 92. This cam is mounted to rotate around an eccentric pivot 93 on a bent arm 94 that can rotate around shaft 95. A stop 96 solid with cam 90 works with a fold 97 of rocker 76 to prevent cam 90 from swinging around pivot 93. A spring 102 pulls bent arm 94 against a stationary stop 101 so that the periphery of cam 90 occupies a position close to the periphery of toothed wheel **63*b*, but does not touch this periphery when fold 97 is in contact with stop 96. Each of the removal mechanisms further comprises a lever 98 pulled by a spring 99, set between lever 98 and bent arm 94, against a part 100 solid with cam 90, to rotate cam 90 when fold 97 is disengaged from stop 96**.

The periphery of cam 90 comprises a first portion **90*a* consisting of teeth that can work with toothed wheel 63*b* and a second smooth portion 90*b* that can slide on these teeth under the action of spring 102**.

The end of bent arm 94 is coupled to a pullrod 105 controlling the sheet separation means and the positioning of alignment stop 27. This alignment stop consists of a comb-shaped part fastened between two arms 107 rotating around a shaft 108 fastened to the frame. A pin 125 solid with pullrod 105, engaged in a slot of wall 41, is connected by a spring 109 to one of arms 107.

Separation means 106 comprise, in the proximity of two side walls 41, a lever 110 mounted on a shaft 111 fastened to the frame and a bracket 112 also rotating around shaft 111. Lever 110 and bracket 112 are connected by a spring 113 pulling bracket 112 to a rest position determined by two stops 114 and 115 carried by lever 110 or bracket 112. Roller 30 of the removal mechanism is mounted to rotate on a shaft 116 held by levers 110. A spring 117 pulls levers 110 into such a position that roller 30 remains in contact with roller 29 fastened to a shaft 118 mounted on bearings solid with the frame. This shaft 118 is driven by platen 3 by gears 119 to 121 so that roller 29 and platen 3 turn in the opposite direction.

Roller 26 comprises a shaft 122 mounted on brackets 112. A toothed wheel 123 solid with shaft 112 engages with a toothing 124 in the form of a segment of a circle carried by one end 124 of one of levers 110. The other end of this lever 110 is made to engage with pin 125 solid with pullrod 105 to control a rotating of lever 110 around shaft 111. The device further comprises a stop 126 intended to fix the exact position of alignment stop 27 during its positioning and of stops 127 to limit the rotating of bracket 122 around shaft 111.

Rollers 26, 29, and 30 are covered with elastomer to assure friction drive of the sheets of paper. The sheet feed drive can be adapted to any printer or typewriter with a control unit 130 that can precisely control the drive of the platen in both directions.

The device functions as follows. When printer control unit 130 receives the order to introduce a given type of sheets stacked on supports 8, 9 and 32, it orders a rotation of platen 3 in a direction opposite the introduction. Platen 3, by gears 62 to 65, drives arm 57 and selection lever 56 in a left rotation. The extent or angle of this left rotation determines which of guide tracks 73 to 75 will be followed by pin 60. Therefore, this angle of rotation constitutes the selection criterion. Gears 62 to 65 were chosen so that the selection is made for rotations of the platen between 2 and 2.5 turns in the direction opposite the introduction of the paper. The direction of driving the platen is then reversed and pin 60 follows one of tracks 73 to 75 to activate one of the removal control parts, consisting of rockers 76 to 78.

The selected rocker pivots around pivot 82 and disengages stop 96. By pressing on part 100, arm 98, pulled by spring 99, drives cam 90 in rotation, which because of its eccentricity comes in contact with toothed wheel **63*b*. This latter is driven in the same direction as platen 3 and drives cam 90 in rotation. Pullrod 105 is then moved a first time to the left in FIG. 2** and successively controls the following operations:

Positioning of alignment stop 27.

Rotating of lever 110 and bracket 112 around shaft 111 until bracket 112 comes in contact with stop 127.

Lever 110 continues its rotating movement and, by means of gears 123, 124, drives roller 26 to the left; in contact with the top sheet contained in cassette 13, this roller moves this sheet by friction upward over a distance of about a centimeter to disengage the lower edge of the sheet from under holding elements 18 of cassette 13, and to form pocket 10 (see FIG. 1).

Cam 90, at this moment, has made a rotation of 180° and begins to move pullrod 105 to the right, controlling the following operations:

Lever 110 rotates in the opposite direction, driving roller 26 to the right, the latter transports the sheet of paper over elements 18 downward.

When the pocket is entirely reabsorbed and the sheet has been laid flat, roller 26 disengages from the sheet which falls freely on alignment stop 27.

Control unit 130 at this moment causes the drive motor to stop for about one second to assure that this fall occurs without hindrance.

After the start of the drive motor, smooth periphery 90*b* comes in contact with wheel 63*b* and slides over it.

Control unit 130 causes another stop of the drive motor. During this stop lever 110, pulled by spring 117, continues to rotate to allow closing of the two drive rollers 29 and 30. Pullrod 105 then causes retraction of alignment stop 27 under the effect of the pull of spring 102 acting on arm 94. Toothed periphery 90*a* then again comes in contact with toothed wheel 63*b*.

The drive motor is started for a period which is a function of the desired length of introduction of paper and controlled by unit 130. During this operation, cam 90 is driven by wheel 63*b* and bent arm 94 comes in contact with rest stop 101.

Lever 98, pulled by spring 99, rests on part 100 separating cam 90 a short distance from drive wheel 63*b*, and its stop 96 comes in contact with fold 97 of rocker 76.

Since gears 62 to 65 are adapted so that it is necessary to make at least two turns of platen 3 in the direction opposite the paper advance for a selection to be effective and since the circumference of platen 3 corresponds approximately to half the length of a sheet of A4 size paper, it is possible in all cases to roll platen 3 back to correct or complete a previously printed line without thereby starting a new cycle of selection and removal.

Introduction of a sheet requires a single movement of platen 3 in a direction opposite to the paper advance to make the paper selection. The platen is then driven in the normal direction of introduction of the paper. The two stops of the drive motor controlled by unit 130 assure an unhindered drop of the paper and a closing of drive rolers 29, 30 in immobile position of the sheet. Of course, these two stops are not essential if the shape of cam 90 is chosen so that the paper has sufficient time to drop an alignment stop 27 before the roller 30 presses on roller 29 so that stop 27 is immediately retracted after the contact of the two transport rollers 29, 30.

Since buckle 10 is entirely reabsorbed before the sheet of paper can drop on alignment stop 27, the drop occurs normally. Transportation mechanism 28 takes this sheet in a predetermined position to introduce it in a controlled fashion into the printer, thus assuring an exact positioning of the sheet on platen 3.

We claim:

1. Sheet feed device for a printer or typewriter comprising a frame, two or more supports on which the sheets to be printed are stored in a stack, a removal mechanism associated with each of the supports intended to remove a sheet from the support for its introduction into the printer, and a selection mechanism intended to activate one of the removal mechanisms, the selection mechanism and the removal mechanisms being driven by a drive element in two opposite directions, characterized in that the selection mechanism comprises a selection lever driven by the drive element and a guide part working with a portion of the selection lever, this guide part comprising a selection slide working with said portion and a number of guide tracks for this portion at least equal to the number of removal mechanisms, the device comprising, associated with each of the guide tracks, a removal control part made to work with the selection lever, each of the guide tracks comprising an opening through which it communicates with the selection slide, the selection lever being pulled by an elastic element to a rest position from which is carried in one direction along the selection guide to said openings, which are made so that said portion follows one of the guide tracks, when the selection lever is moved in a second direction opposite the first to work with one of the removal control parts.

2. Device according to claim 1, in which the drive consists of an element for driving the platen of the typewriter, wherein the device is made so that a movement of the selection lever in said first direction corresponds to a rotation of the platen in the direction opposite the introduction of the paper, the selection lever working with one of the removal parts when the platen turns in the direction of introduction of the paper.

3. Device according to one of claims 1 or 2, wherein the device comprises an elastic element made to pull said portion of the selection lever on one of the guide tracks when the lever is moved in said second direction.

4. Device according to claim 1, wherein the selection slide and guide tracks consist of sectors of concentric circles, the selection lever being mounted at one of the ends of a selection arm whose other end is fastened to a pivot whose axis is located approximately in the center of the concentric circles.

5. Device according to claim 4, wherein the selection slide has a radius greater than the circles of the guide tracks and wherein said elastic element consists of a spring connecting the arm to the selection lever to pull said portion of the selection lever in a direction approximately radial to the selection slide.

6. Device according to claim 1, wherein the guide tracks are shaped to bring the selection lever to its rest position, when it is driven in said second direction.

7. Device according to claim 2, comprising a gear between the platen and a toothed wheel intended to drive the selection lever, wherein this gear is so shaped that the periphery of the platen makes a movement, in a first direction, approximately equal to the length of the sheets to be printed, before the selection lever has reached said openings communicating with one of the guide tracks.

8. Device according to claim 7, wherein it comprises an overriding clutch between said toothed wheel and the selection lever made to couple the toothed wheel to this lever when the platen turns in said first direction, and a stop intended to hold the selection lever in its rest position when the platen turns in the opposite direction.

9. Device as in claim 8, wherein the clutch comprises an element able to uncouple the selection lever from the toothed wheel, this element working with a stationary stop made so that the element comes in contact with the stop when the selection lever is driven in said first direction over a predetermined amplitude greater than the distance separating the rest position from the farthest opening.

* * * * *